US005853239A

United States Patent [19]

Laib et al.

[11] Patent Number: 5,853,239

[45] Date of Patent: Dec. 29, 1998

[54] DRAWER ORGANIZER

[75] Inventors: Douglas M. Laib, Orlando; Samuel E. Hodges, Leesburg, both of Fla.

[73] Assignee: Dart Industries Inc., Orlando, Fla.

[21] Appl. No.: 898,933

[22] Filed: Jul. 23, 1997

[51] Int. Cl.[6] ..... A47B 88/00

[52] U.S. Cl. ..... 312/348.2; 312/348.3; 312/263; 220/4.33

[58] Field of Search ..... 312/257.1, 263, 312/265.5, 265.6, 348.1, 348.2, 348.3, 348.5, 193; 220/4.33, 4.28, 533, 532, 529; 403/329, 326, 292, 293, 294, 295; 211/184; 108/61, 60, 64, 65, 185

[56] References Cited

U.S. PATENT DOCUMENTS

| | | | |
|---|---|---|---|
| 741,362 | 10/1903 | Ohnstrand | 220/4.33 |
| 1,266,981 | 5/1918 | Olesen | 108/185 |
| 1,672,562 | 6/1928 | Evans | 403/294 |
| 2,214,042 | 9/1940 | Burdick . | |
| 2,268,637 | 1/1942 | Bernstein . | |
| 2,747,959 | 5/1956 | Ingelson . | |
| 3,696,960 | 10/1972 | Smirle | 220/4.33 X |
| 3,699,709 | 10/1972 | Schmidt . | |
| 3,750,894 | 8/1973 | Jensen et al. . | |
| 3,834,778 | 9/1974 | Morrison et al. . | |
| 4,061,084 | 12/1977 | Bakkeren | 220/4.28 X |
| 4,595,105 | 6/1986 | Gold | 211/184 X |
| 4,595,246 | 6/1986 | Bross . | |
| 4,768,661 | 9/1988 | Pfeifer . | |
| 4,774,733 | 10/1988 | Akers | 403/294 X |
| 4,793,725 | 12/1988 | Cheng . | |
| 4,807,760 | 2/1989 | Sussman . | |
| 4,919,268 | 4/1990 | Young et al. . | |
| 4,941,611 | 7/1990 | Arsenault . | |
| 5,183,163 | 2/1993 | Slaiken . | |
| 5,242,223 | 9/1993 | Koves . | |
| 5,311,993 | 5/1994 | Koch | 220/533 X |
| 5,553,856 | 9/1996 | Barnard . | |
| 5,593,058 | 1/1997 | Spencer et al. | 220/4.28 X |

*Primary Examiner*—Janet M. Wilkens
*Attorney, Agent, or Firm*—John A. Doninger; Taylor J. Ross

[57] ABSTRACT

Multiple assemblable components are engaged by connectors positioned across abutment edges on adjacent components and received within recesses in the base panels of adjacent components to form a planar upper surface. Selected ones of the components have vertical walls which can be connected in back-to-back relation to each other by clips. The connectors can include depending projections engaged within openings in the recess bottoms, with selected connectors having upwardly projecting elongate dividers mounted thereto.

20 Claims, 7 Drawing Sheets

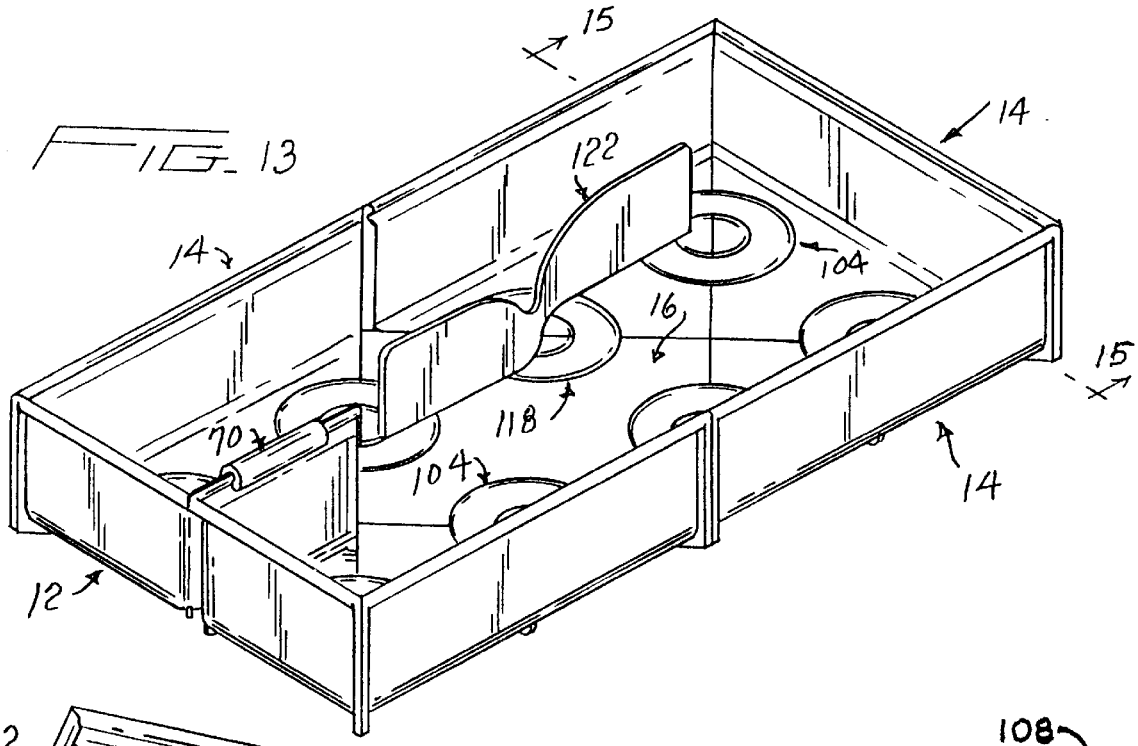
FIG. 13
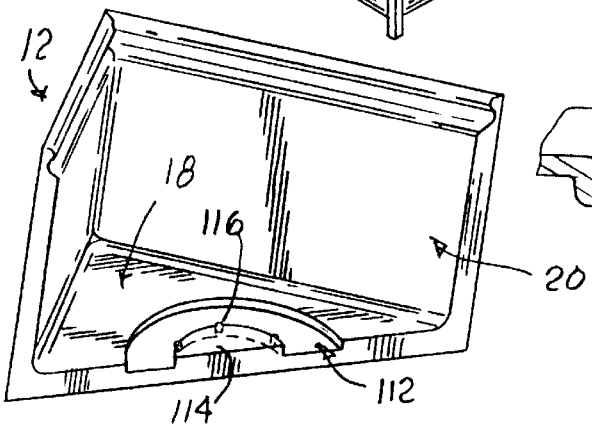
FIG. 14
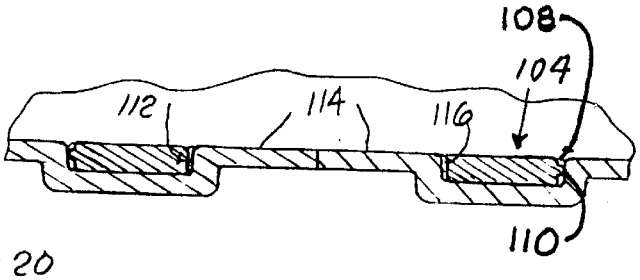
FIG. 16
FIG. 15
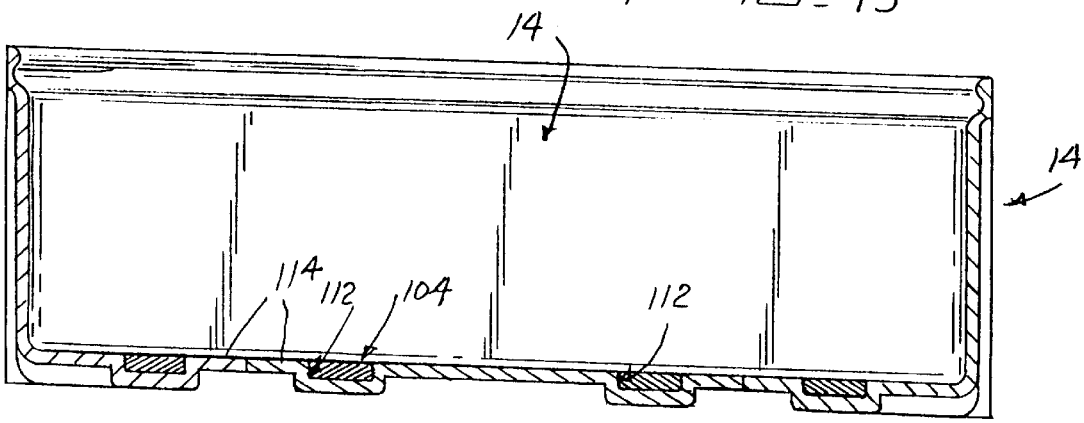

DRAWER ORGANIZER

BACKGROUND OF THE INVENTION

The invention is broadly concerned with drawers and means for facilitating organization of drawer contents.

The conventional drawer is normally devoid of any interior dividers or means for separately grouping the contents of the drawer. This is a particularly undesirable feature in kitchen drawers wherein multiple kitchen utensils of several different types are to be stored. In attempting to address this problem, custom-made drawers can be provided with fixed partitions or partitions which can be selectively positioned in pre-formed wall slots. The problem is also conventionally addressed by providing multiple compartment drawer inserts or trays of wood or an appropriate synthetic resinous material.

Such known systems for dividing the interior of a drawer are inherently rather limited in that the user of the drawer must adhere to an arrangement of the drawer compartments dictated by the manufacturer of the drawer or by the uniform pre-manufactured divider trays received therein.

SUMMARY OF THE INVENTION

The present invention involves a drawer organizer construction utilizing multiple separate components or modules which can be assembled by the ultimate user in any of a substantial variety of arrangements for an accommodation to the interior of drawers of substantially any configuration in a manner as to provide interior divided compartments in accord with the specific requirements of the user.

The components, when assembled, are particularly adapted to form an organizer which, in addition to having a divided or partitioned interior, forms a self-contained tray having peripheral side walls and a base with a smooth planar upper surface, presenting the appearance and unity of a preformed tray without the inherent limitations of such a preformed tray.

Another significant feature of the invention is the ability of the organizer, and in particular the components thereof, to be readily and easily disassembled for cleaning, rearrangement, and the like.

Basically, the drawer organizer includes corner components and side components, both of which have a base panel and at least one wall panel. A base component, without walls, is also provided as are a plurality of connectors in the nature of substantially flat plates which engage within keeper recesses formed in adjacent portions of edge joined ones of the components, the thickness of the connector plates being equal to the depth of the recesses to provide a desired flush surface. The connectors and recesses cooperate in a manner whereby lateral separation of the connected components is precluded, thus avoiding any unintentional or accidental disassembly within a drawer. As designed, selective ones of the connectors can include divider panels integral with the upper surface thereof and extending therebeyond into overlying relation to adjacent ones of the basic components.

In selected arrangements of the components, the walls of adjacent components can parallel and engage each other. In such cases, wall clips will be used to releasably fix the adjacent walls to each other and further stabilize the overall construction.

These and other features and objects of the invention will become readily apparent from the more detailed description following hereinafter.

BRIEF DESCRIPTION OF THE DRAWINGS

FIG. 13 is a top perspective view illustrating a further variation utilizing annular connectors and semi-circular recesses;

FIG. 14 is a top perspective view of a corresponding corner component;

FIG. 15 is an enlarged cross-sectional detail taken substantially on a plane passing along line 15—15 in FIG. 13;

FIG. 16 is an enlarged cross-sectional detail through a pair of connector joined adjacent components;

DESCRIPTION OF PREFERRED EMBODIMENTS

Figure 1:
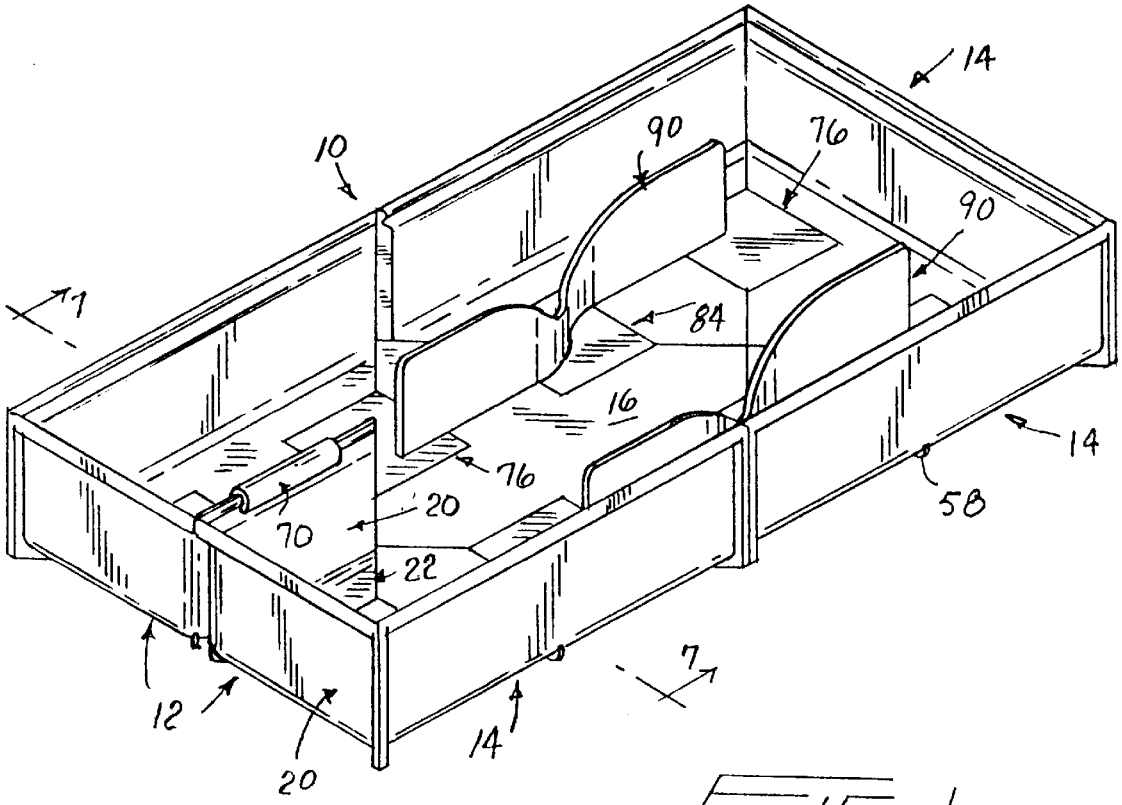
FIG. 1 is a top perspective view of one form of assembled drawer organizer.
Figure 2:
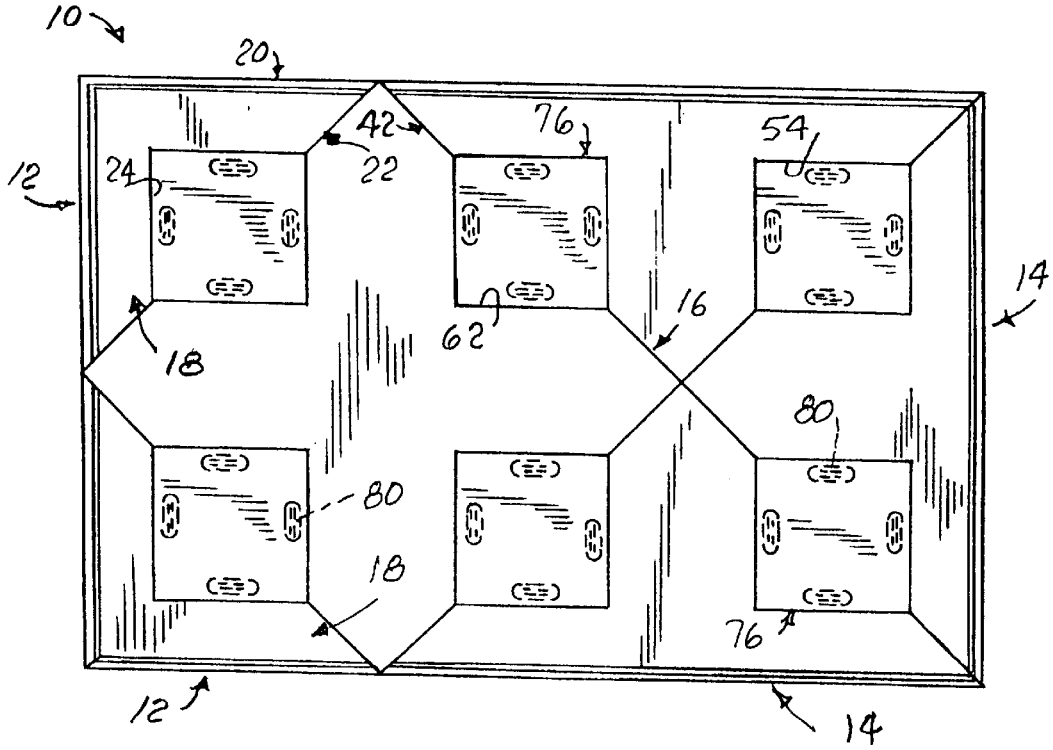
FIG. 2 is a top plan view illustrating a different assembly of the components.

The drawer organizer 10, as noted in particular in FIGS. 1 and 2, is an arrangement or assembly of the basic components or modules which individually and collectively, in the manner of a kit, define the invention. These components include, but are not necessarily limited to, corner components 12, side components 14, and base components 16.

Figure 8:
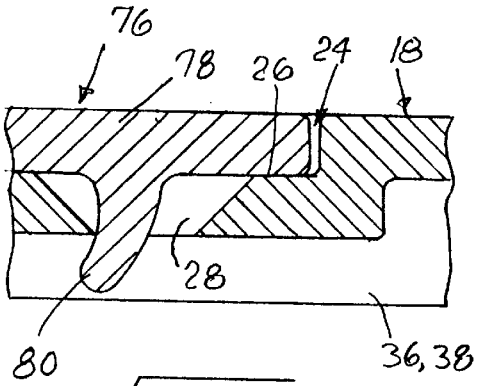
FIG. 8 is an enlarged cross-sectional detail through an engaged connector retaining lug.

Each corner component 12 includes a triangular base panel 18 with peripheral edges comprising a pair of equal length edges at substantially 90° to each other, and a third edge therebetween completing the triangle. Walls 20, integral with the base panel 18, extend vertically from the two equal length peripheral edges and are preferably integrally joined at the corners defined therebetween. The third base panel edge, designated by reference numeral 22, is a free linear abutment edge forming an angle of substantially 45° with the two other edges. The base panel 18, immediately adjacent this edge 22, is downwardly offset and defines a right isosceles triangular recess 24 with one side of the recess 24 along the free edge 22 and with the recess opening through this edge. The recess is of a constant depth, with the bottom 26 of the recess paralleling the remainder of the base panel 18. The recess 24 is centrally located along the base edge 22 and terminates well inward of the opposed ends of the edge 22. Finally, a pair of keepers or keeper slots 28 are provided through the bottom 26 of the recess 24 centrally along and spaced slightly inward of the two converging inner edges of the recess. These slots 28, noting the detail of FIG. 8, have wide mouths with inwardly and downwardly tapering side camming walls.

Referring again to the corner component walls 20, the upper edge portion of each wall is slightly outwardly offset and has a full length inwardly directed bead 30 therealong defining a full length undercut groove 32 immediately therebelow and along the inner face of the corresponding wall 20. The free vertical edge 34 of each of the walls 20 is slightly wider than the thickness of the body of the wall 20 and projects to the rear thereof a distance equal to the offset of the upper edge portion to combine therewith in reinforcing the periphery of the corner components 12. Each of these edges 34 is formed at substantially 45° along the height thereof to align in the same plane as the base panel free edge 22 and, when meeting with similarly formed wall edges, define a substantially right angular recess to receive a corner of the base component 16, or alternately to position adjacent walls at right angles to each other as will be noted in FIG. 2.

Figure 6:
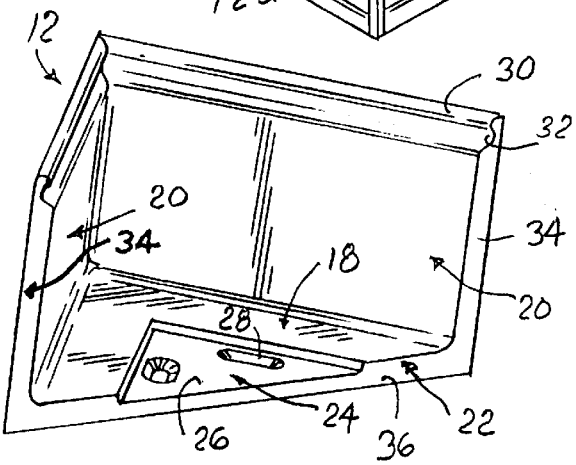
FIG. 6 is a top perspective view of a corner component.

As it is desirable to slightly elevate the floor of the organizer 10, the corner component base panel 18 has, along the full length of the free edge 22, a depending flange 36 which extends below the bottom of the recess 24 and which has a front face coplanar with the edge face. Noting FIG. 6 in particular, it will be seen that the edge 22 and integral flange 36 present the appearance of a wide planar edge surface which continues through and coplanar with the lower portions of the free vertical edges 34 at the opposed ends thereof.

A second support flange 38, integral with the under or bottom surface of the base panel 18, bisects the angle at the corner between the walls 20 and extends from the corner to the downwardly offset portion of the base panel which defines the recess 24. As will be appreciated, the height of the flange 38 is equal to that of the flange 36, both of which extend below the recess-defining offset as will be best noted in FIG. 5 and the detail of FIG. 8.

Turning now to the side components 14, each of these components comprises a base panel 40 configured as a right angle isosceles triangle with two free edges 42 of equal length and of a length equal to the free edge 22 of the corner component 12. The third or rear edge of the base panel 40, which extends at 45° to the free edges 42, has an integral wall 44 coextensive therewith and projecting upwardly therefrom. The wall 44 duplicates the walls 20 in cross section, and includes an offset upper portion with a defined inwardly directed bead 46 and underlying groove 48. Integral depending flanges 50 are coextensive and coplanar with the free edges 42 and with the lower portions of the beveled wall edges 52. These edges 52, similar to the edges 34, are defined by rearwardly directed flange-like portions which are slightly wider than the thickness of the wall panel 44 itself, with the beveled surface being at substantially 45° to correspond to the angles of the free edges 42 relative to the rear wall-mounting edge.

The base panel 40, immediately adjacent each free edge 42, is downwardly offset to provide a pair of right isosceles triangular recesses 54 which duplicate the corner component recesses 24 and are similarly provided with a pair of keepers or keeper slots 56 through each recess bottom.

As an additional support for the base panel 40, a third support flange 58 is integral with and depends from the bottom surface of the base panel 40, extending inwardly from the rear edge thereof toward the forward apex defined by the converging free edges 42. This flange 58, as illustrated in FIG. 5, will normally terminate at some point between the recess-defining offsets.

The third component, the base component 16, comprises a flat base panel 60 of a square configuration with each edge 61 comprising an abutment edge and being of equal or substantially equal length with the free edge 22 of the corner component 12 and the free edges 42 of the side component 14. The base panel 60, immediately adjacent each of the edges, is downwardly offset to define a right isosceles triangular recess 62 opening outward centrally of each edge. These recesses 62 duplicate the recesses 24 and 54 and similarly include two keepers or keeper slots 64. It is to be appreciated that the defined recesses 24, 54 and 62 are so located relative to their respective edges as to align, upon an alignment of the components, and define a composite recess with four equal sides.

Figure 5:
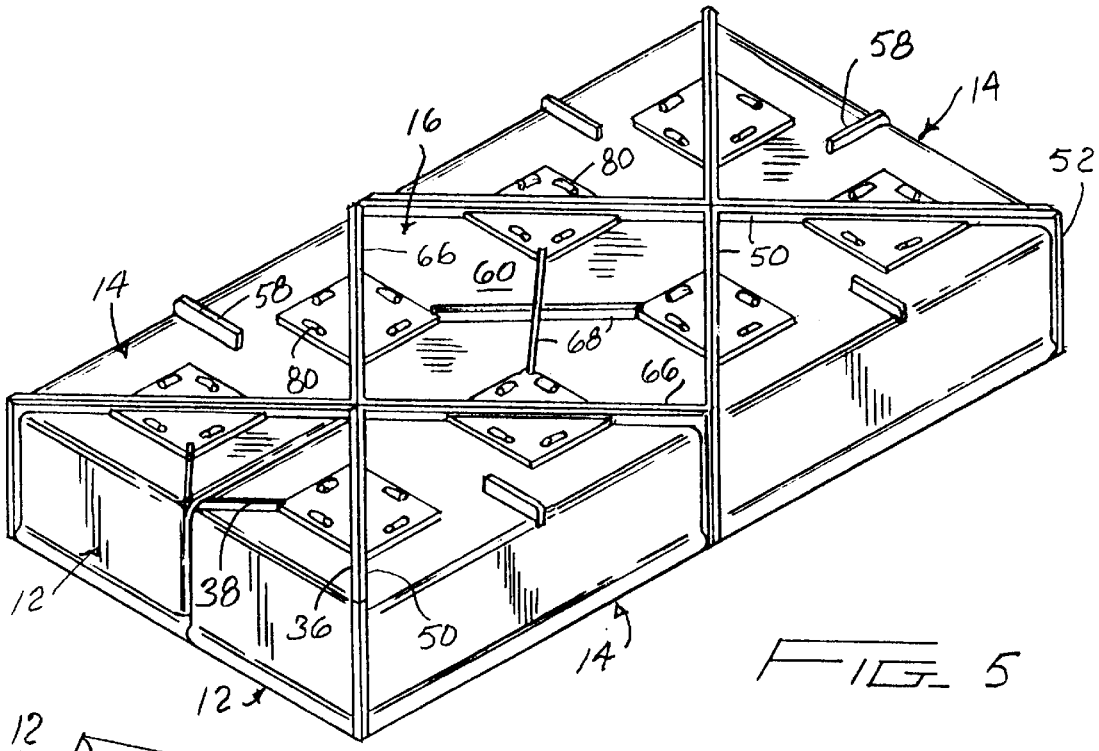
FIG. 5 is a bottom perspective view of the assembly of FIG. 1.

The base panel 60 on the base component 16, for an appropriate elevation thereof, is also provided, as best seen in FIG. 5, with depending edge flanges 66 coextensive with and providing coplanar outer faces with each of the base component edges. Similar support flanges 68 extend transversely across the undersurface of the base panel 60 between the inner apex ends of diametrically opposed recesses 62.

Figure 7:
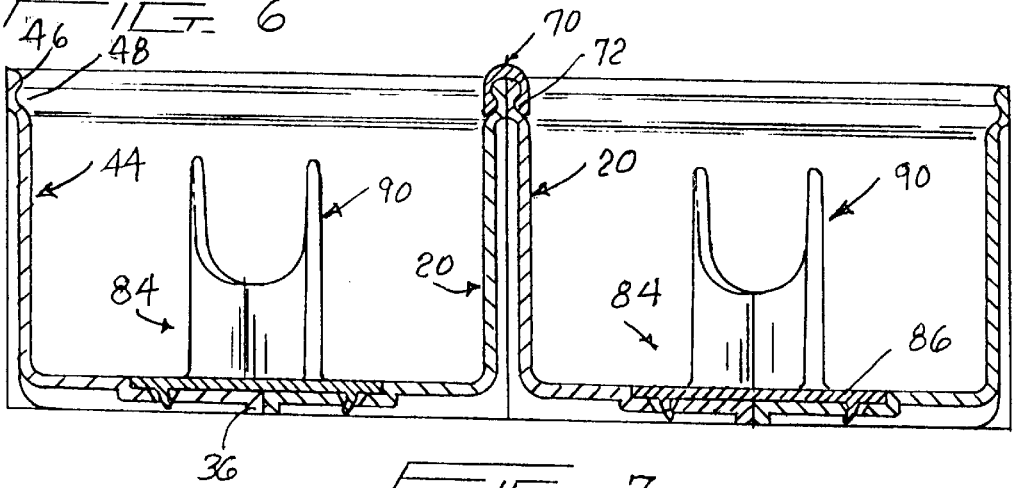
FIG. 7 is a cross-sectional view taken substantially on a plane passing along line 7—7 in FIG. 1.
Figure 9:
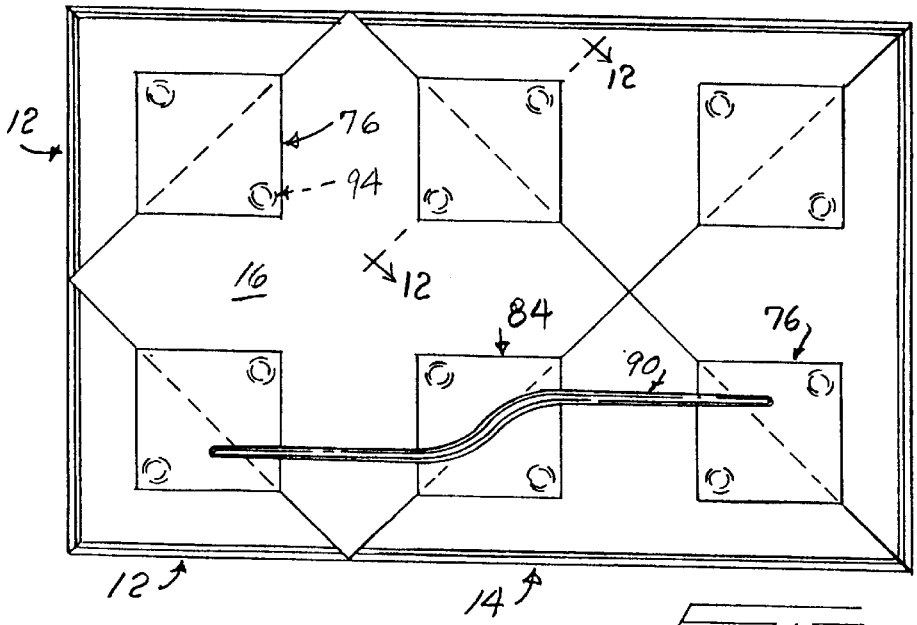
FIG. 9 is a top plan view of an assembly, similar to the assembly of FIG. 2, wherein the connectors utilize a different form of retaining lug.
Figure 10:
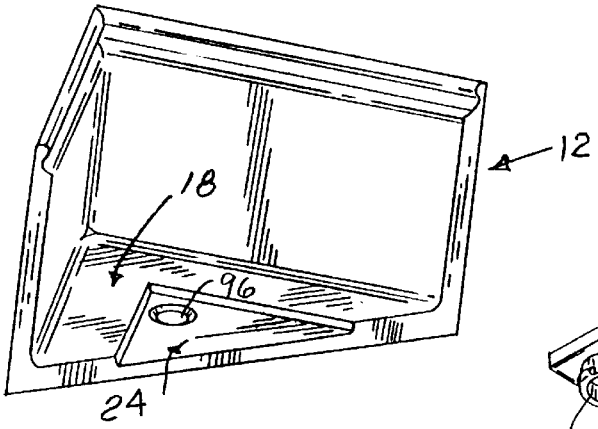
FIG. 10 is a top perspective view of a corner component modified to accommodate the different form of lug.
Figure 11:
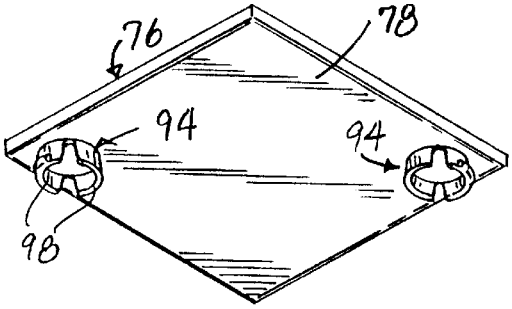
FIG. 11 is a bottom perspective view of the connector and modified lugs thereon.

As will be appreciated from FIGS. 1 and 2, the components 12, 14 and 16 can be arranged in a variety of configurations, providing custom formed drawer organizers. Note, for example, in FIG. 1 wherein two corner components 12 are arranged with walls 20 placed back to back and extending into the interior of the organizer. In such case, a flexibly resilient mounting clip 70, in the nature of a split sleeve, can be snap-locked over the wall beads 30 and engaged within the grooves 32. Each such clip 76, noting the cross-sectional detail of FIG. 7, can have the mouth-defining lower edges of the opposed walls thereof provided with beads 72 which, upon being snap-engaged within the grooves 32, provide for a positive locking of the walls 20 to each other.

As an alternate to use of the corner components in this manner, attention is directed to FIG. 2 wherein the corner components 12 actually define a pair of corners of the organizer.

In assembling the components, after the desired layout is determined, the free edges of the adjacent components are brought into intimate engagement with each other. As previously indicated, these edges are all of the same length and thus define smooth full length abutment edges with the central recesses of each pair of abutment edges aligning to define composite rectangular recesses. These composite recesses in turn closely receive connectors 76, each comprising a flat square plate 78 closely conforming to and of equal height with the composite recess defined by two adjacent recesses, for example recesses 24 and 62. The connector plate 78 in turn includes four depending lugs 80 integral with the lower surface thereof and located centrally of and adjacent each of the four connector plate edges and aligned so as to engage, by a snap-lock engagement, through corresponding ones of the recess slots 28, note particularly FIG. 8. The lugs 80 are elongate and slightly arcuate in cross section, defining a slightly curled lower edge portion which, upon a positioning of the connector 76, resiliently flexes slightly outward as it moves along the camming surfaces of the corresponding slot 28 until such time as the lower edge portion of the lug 80 passes beyond or below the bottom of the corresponding recess and, through the inherent resiliency or biasing nature thereof, moves to a position slightly underlying the bottom immediately to one side of the corresponding slot 28. As will be noted in FIG. 8, the slot is of a width allowing for the slight lateral flexing of the lug 80 required to properly engage the lug. It is contemplated that the length of each of the lugs 80 be only slightly less than the length of the slots 28 for rather close reception therein. The connector, when so mounted, precludes lateral separation of the joined components, while still allowing for disassembly for repositioning, cleaning, and the like.

The assemblage of components and connectors also includes connectors 84, each of which includes a planar square plate 86 with four depending elongate lugs 88 which duplicate the plate 78 and lugs 80 of the connector 76. In addition, the connector 84 includes, preferably integral with the plate, an upwardly projecting divider 90 extending transversely thereacross and beyond a pair of opposed side edges of the plate 86 an appreciable distance at least sufficient to partially overlap the connectors 76 securing adjoining components. The divider 90 may be linear or, as illustrated, have end lengths laterally offset from each other through an arcuate central portion directly overlying the plate 86 as illustrated. Such dividers, positioned adjacent a side wall of the organizer as the dividers in FIG. 1, will provide a divided compartment with a large area for, as an example, the enlarged head of soup spoons and a narrow adjacent portion for the handles thereof. As such, a particularly useful customization of the organizer is possible.

Figures 3, 4:
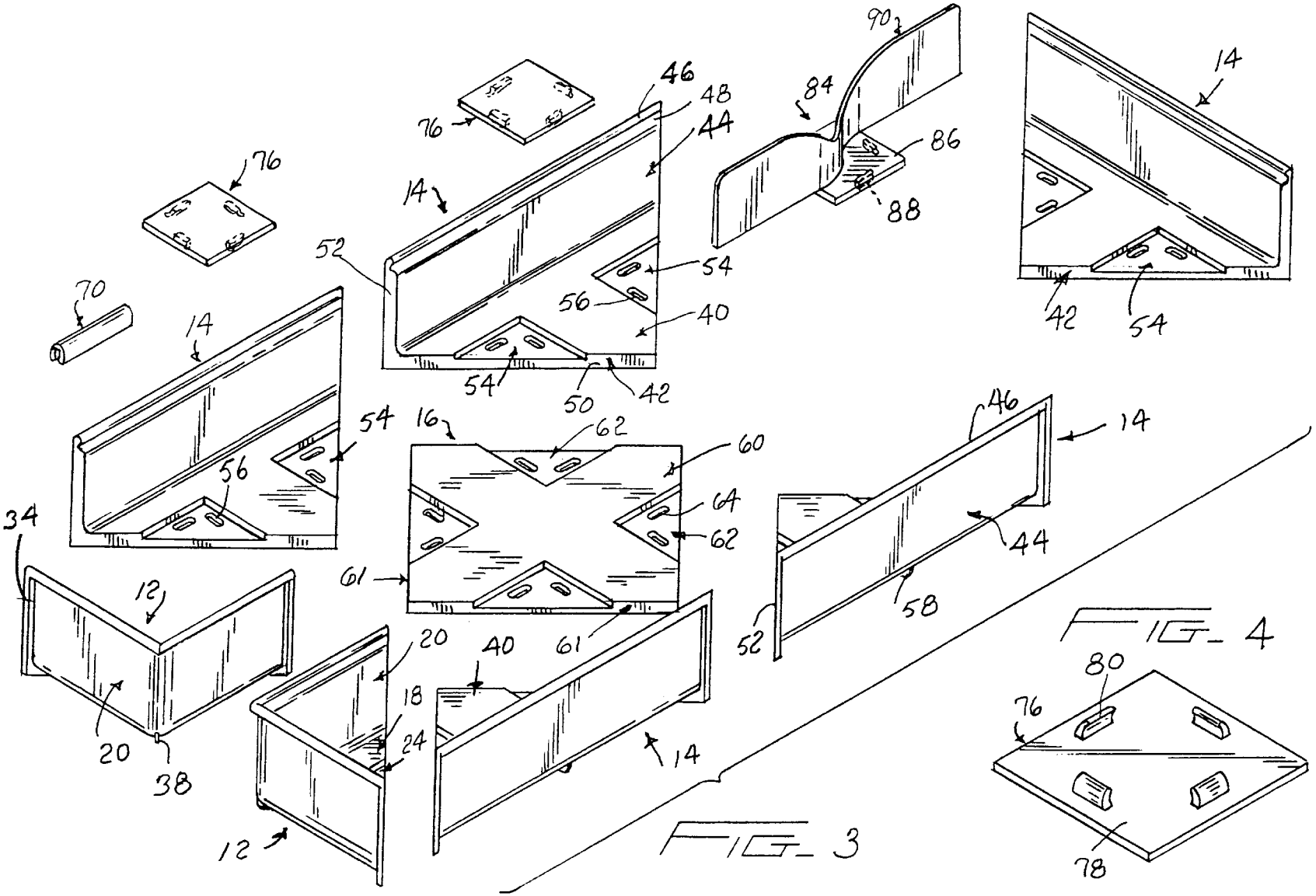
FIG. 3 is an exploded perspective view illustrating selected ones of the individual components, connectors and clip of the assembly of FIG. 1.
FIG. 4 is a bottom perspective view of a connector.

FIG. 3 is of particular interest in illustrating all of the components as well as several of the connectors and divider-connectors used to assemble the organizer 10 of FIG. 1, thus giving a clear picture as to the organization and alignment of the components.

FIGS. 9–12 illustrate a second embodiment of the invention, along with a slightly different organizer arrangement (FIG. 9), wherein the only difference from the embodiment of FIGS. 1–8 resides in the manner in which the connectors 76 and 84 are secured. Accordingly, like reference numerals have been applied to like parts.

Figure 12:
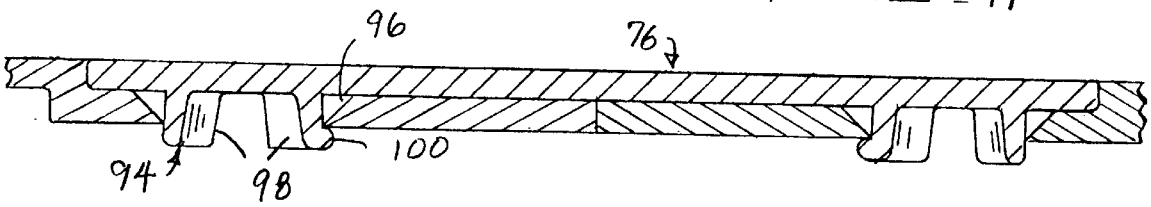
FIG. 12 is an enlarged cross-sectional detail taken substantially on a plane passing along line 12—12 in FIG. 9.
Figure 17:
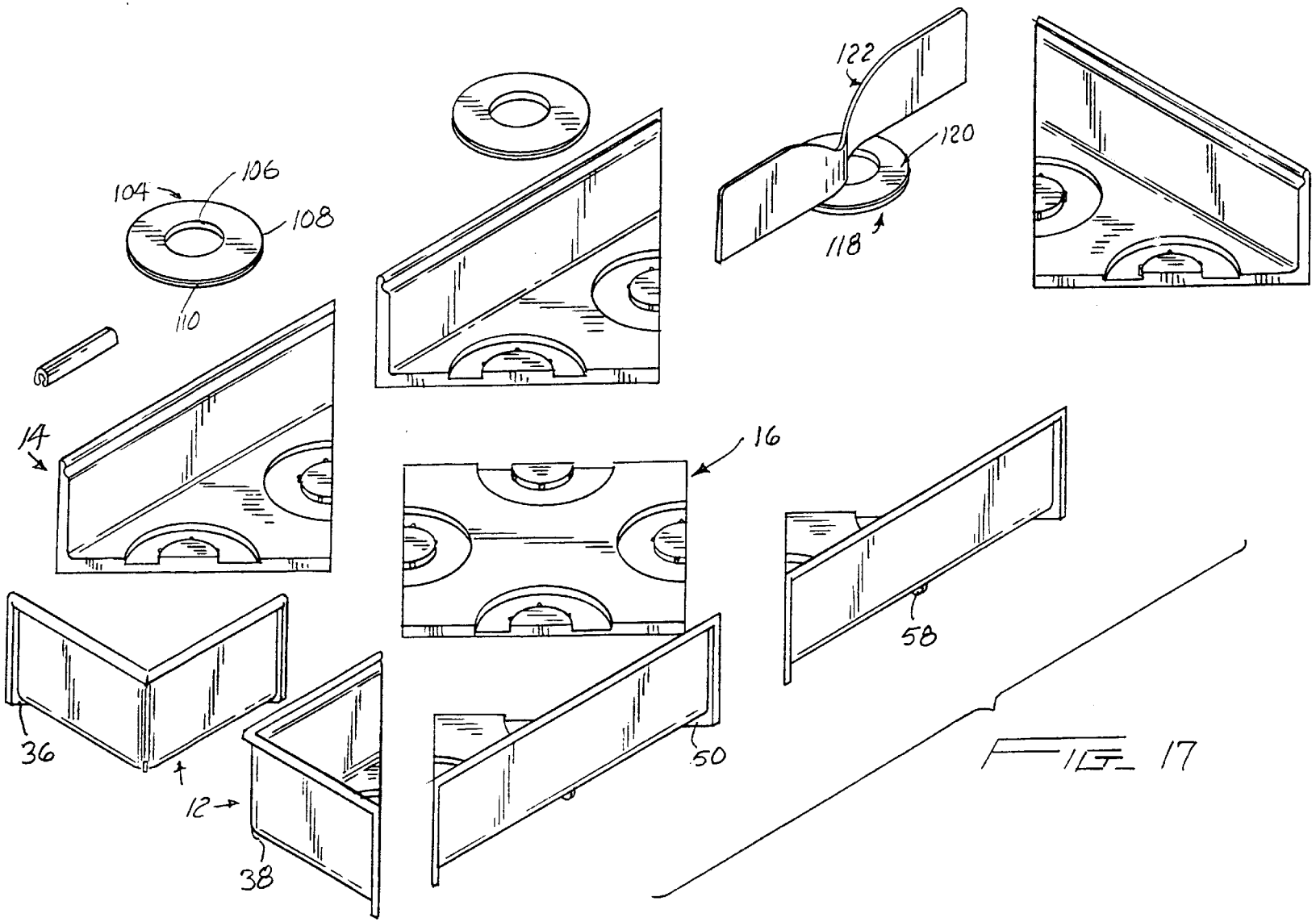
FIG. 17 is an exploded perspective view illustrating the components and connectors of the assembly of FIG. 13.

The specific difference resides in the provision of snap-locking split plugs 94 at one pair of diametrically opposed corner portions of the connector base plate 78, 86 for snap-locking engagement through a pair of keepers or keeper openings 96, one located through the bottom of a corresponding recess immediately inward of the inner apex thereof. The keeper openings, noting the cross-sectional detail of FIG. 12, will have peripheral walls of an inverted conical configuration for a resilient inward flexing or camming of the opposed arcuate portions 98 of the received plug 94. One of these arcuate portions 98 will preferably have an outwardly directed bulbous lower edge or extension 100 to engage beneath the surface of the base panel of the corresponding component for a positive interlock of the connector and the component. FIG. 12 also illustrates a slight downward and outward flaring of the two plug sections 98 relative to each other to ensure a tight engagement of the plugs when the connector is fully seated. Incidentally, as with the first embodiment, the thickness of the connector base plates 78 and 86 is equal to the depth of the recesses 24, 54 and 62.

A further embodiment of the invention is illustrated in FIGS. 13–17. Again in this embodiment, the difference from the first completely described embodiment resides solely in the manner in which the components are joined against lateral separation. As such, like reference numerals have been applied to like ones of the components and common features thereof.

The basic connectors 104 are each in the nature of a flat annular plate with an inner circular periphery 106 defining a circular opening, and an outer circular periphery 108. The outer periphery 108, at mid-height thereon, has a small annular bead 110 completely thereabout.

The recesses 112 located in the base panels of the components 12, 14 and 16, comprise flat semi-circular arcs, the opposed ends of which open through the forward edges of the base panels. These arced recesses in each instance define a central semi-circular portion 114 at the full height of the base panel. The semi-circular edge of this semi-circular portion 114 includes small rounded projections 116 at approximately three spaced points therealong, such projections 116 being inwardly directed toward the formed recess 112.

Upon a positioning of the components in an assembly, the recesses 112 in adjacent edges combine to define a composite annular recess which receives a connector 104 in surrounding relation to the circular central portion defined by the adjacent semi-circular portions 114. So assembled, the adjacent semi-circular portions 114 act in effect as keepers for the annular connector 104 precluding a lateral separation of the components.

The peripheral bead 110 on the connector 104 and the small projections 116 on each semi-circular portion 114 facilitate insertion of the annular connector 104 within the combined recesses 112 and ensure a snug yet non-binding reception. This is particularly significant with regard to the divider-mounting connector 118 wherein the flat annular plate 120 duplicates the plate 104 with the divider 122 fixed diametrically thereacross so as to project radially beyond the outer periphery and overlie the central opening. The divider 122 can have laterally offset end portions or may be formed in a single plane. Further, as the connector plate 120 is annular and received within a composite annular recess, it is possible to rotate the connector 118 with the divider 122 thereon to provide a degree of variation in the compartment or chamber formed thereby in the assembled organizer. Such a rotational adjustment is facilitated by the outer peripheral bead 110 on the connector and the projections 116 on the composite circular central portion formed by the combined portions 114.

Noting FIGS. 15 and 16 in particular, it will be appreciated that the recesses 112, as with the previously described triangular recesses, are formed by a downward offsetting of the bottom panels of the associated components, thus maintaining a desired constant thickness of material.

A final illustrated embodiment is presented in FIGS. 18–21. This embodiment differs from the embodiment of FIGS. 13–17 principally in the construction of the walls 20' and 44' of the corner components 12' and the side components 14'. The base component 16' is the same as in the embodiment of FIG. 13. In light of the substantial similarities of this embodiment with the previously described embodiments and the duplicate functions of the components and various other elements, like reference numerals have been applied with the addition of a prime (') as a recognition of the substantially duplicate nature of such parts.

Each of the walls 20' and 44' has the body thereof of constant thickness and defined by a series of vertical inwardly and outwardly directed alternating flutes 126 and ribs 128. Basically, each wall, in horizontal cross section, is formed in a generally sinusoidal configuration.

The walls have coextensive top flanges 130, the inner edges of which follow and are coplanar with the inner surface of the corresponding wall panel 20', 44', while the outer edge 132 thereof is linear and in a vertical plane at or slightly beyond the formed ribs on the outer surface of the corresponding wall panel 20', 44'. The opposed vertical edge portions 134 of the walls extend to the plane of the linear rear edge 132 of the top flange 130 and have beveled forward faces thereof in the plane of the free edge of each component base panel, for example edge 22' of base panel 18' in FIG. 19.

Figure 18:
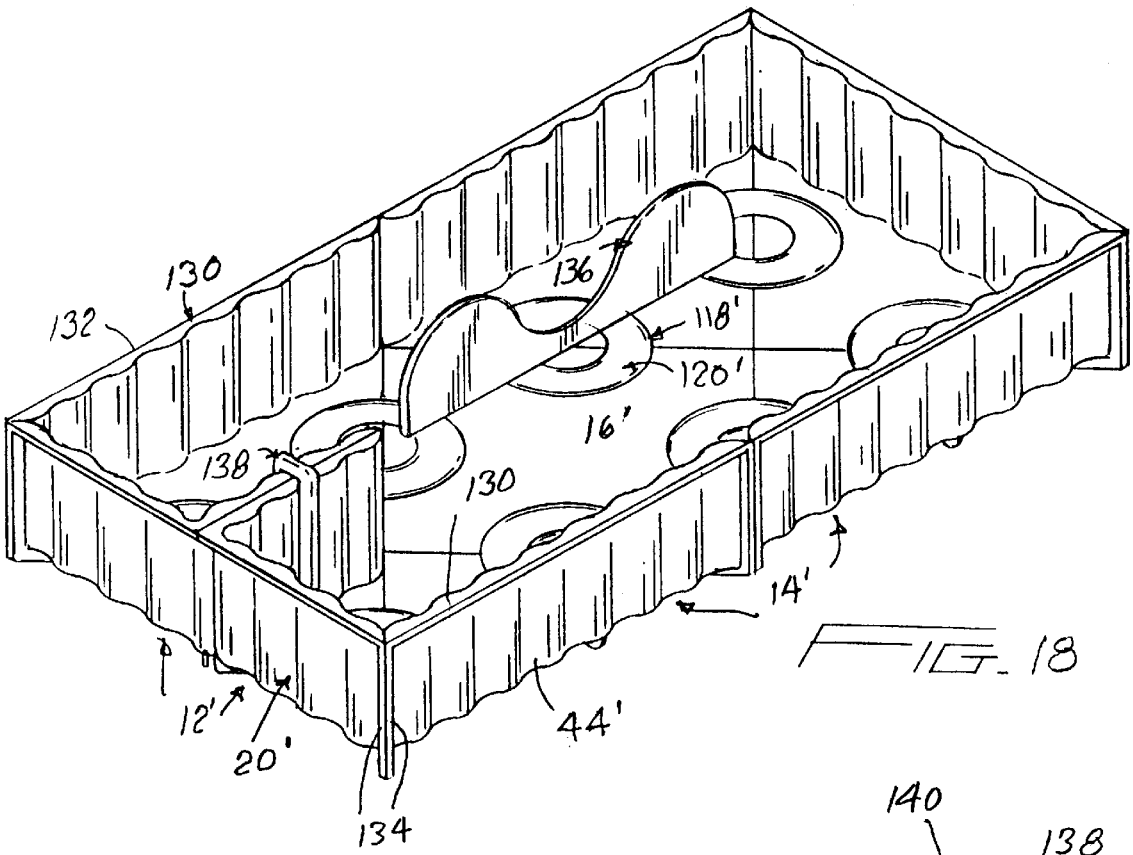
FIG. 18 is a top perspective view of an assembly of a further variation of components wherein the walls are defined by alternating vertical flutes and ridges in a generally sinusoidal pattern.

Noting FIG. 18, it will be seen that the divider-mounting connector 118' mounts a planar divider 136 as an alternate divider configuration to the previously illustrated dividers. This divider, as with the previously described dividers, has the opposed radially extending portions thereof at a substantially greater height than the intermediate portion thereof which directly mounts to the corresponding connector plate 120'.

Figure 20:
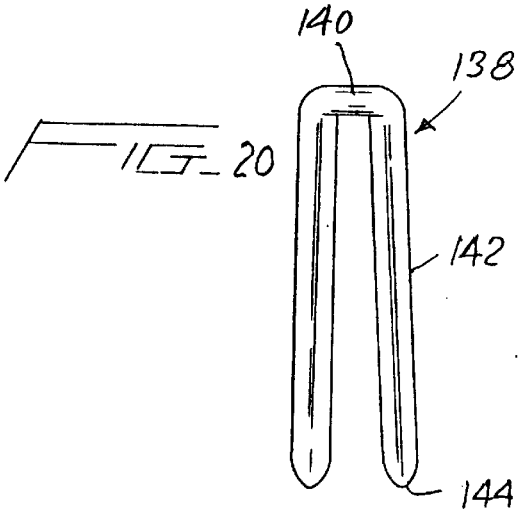
FIG. 20 is an enlarged elevational view of a clip utilized to secure parallel back-to-back walls of the components of FIG. 18.
Figure 19:
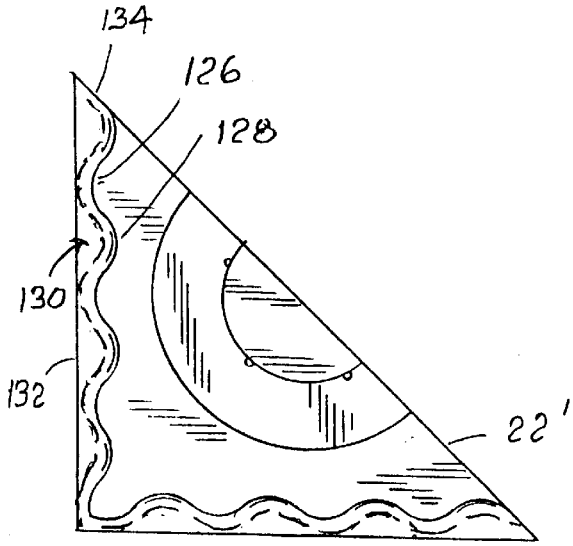
FIG. 19 is a top plan view of a corner component of the assembly of FIG. 18.
Figure 21:
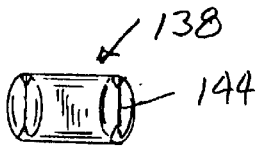
FIG. 21 is a bottom plan view of the clip of FIG. 20.

In order to retain back-to-back walls 20' of adjacent components 12', as illustrated in FIG. 18, a clip 138, detailed in FIGS. 20 and 21, is used. The clip 138 has a bight 140 at the upper end thereof and a pair of elongate laterally spaced legs 142 depending therefrom and slightly downwardly diverging to terminate in slightly rounded lower ends 144. The bight 140 is of a length as to allow for a snug reception of the two depending legs 142 in back-to-back flutes 126 provided in a pair of back-to-back walls 20'. The slightly downwardly diverging legs allow for easy alignment and reception of the clip 138 over the walls with a gradual tightening of the walls against each other as the clip 138 approaches its final seated position.

Finally, appropriate support flanges, similar to those described and possibly best illustrated in FIG. 5, are integrally formed along and coplanar with the free edges of the various components as well as along selected intermediate portions of the undersurface of the corresponding component base panels to define a slightly elevated floor to the organizer.

From the foregoing, it will be appreciated that drawer organizers of a variety of configurations and internal portioning can be defined from selected assemblages of unique corner, wall and base components with the components fixedly secured in a desired configuration by connectors engageable within upwardly opening recesses communicating with duplicate recesses in adjoining components. The connectors present smooth upper surfaces with the component base panels for a smooth bottom to the assembled organizer with lateral separation being prevented by cooperating means on the connectors and the components. Such means preferably comprise depending locking lugs on the connectors engaged within slots in the bottom of the connector receiving recesses. Alternately, the connector can be provided with split plugs received within cooperating openings, or the connector can be in the nature of an annular flat ring received within semi-circular recesses and precluded from lateral withdrawal by a semi-circular portion about which the semi-circular recess is defined. Provision is also made for securing selected ones of the component walls in back-to-back relationship.

The foregoing is considered illustrative of the invention. While several embodiments have been presented, it is to be appreciated that other embodiments as fall within the parameters of the claims following hereinafter are also to be considered within the scope of the invention.

We claim:

1. A drawer organizer, comprising:

multiple components for selective assembly, each of said components including a base panel having at least one opening therein and at least three edges, at least one of said edges being an abutment edge, said abutment edge of each of said components, upon assembly of said components into said drawer organizer, being immediately adjacent said abutment edge of an adjacent one of said components, and a portion, but less than all, of said components further including a wall extending upward from one of said at least three edges other than said abutment edge, each of said walls having an inner face with a groove defined therein, said components being assemblable with said walls of adjacent ones of said portion of said components in parallel adjacent engagement;

a plurality of connector plates for releasably securing said adjacent ones of said components, each of said connector plates having a mounting position in an overlying relationship to said base panels of said adjacent ones of said components, each of said connector plates including a plurality of projections extending therefrom, said projections being located to be received and releasably secured within said openings in said base panels of said adjacent ones of said components when said connector plates are in said mounting position; and at least one mounting clip for releasably securing said walls of said adjacent ones of said portion of said components, each said at least one mounting clip selectively extending over said walls of said adjacent ones of said portion of said components with free ends of said at least one mounting clip received within said grooves.

2. A drawer organizer as in claim 1, wherein each of said base panels includes an upper surface, and further includes a recess associated with each of said at least one abutment edges, each said recess extending into said upper surface of an associated one of said base panels, and opening on to said associated abutment edge, said recesses being positioned upon said base panels such that, upon assembly of said components into said drawer organizer, said recesses of said adjacent ones of said components are at least partially coextensive to together define a combined recess shape, and wherein each of said connector plates has a shape corresponding to said combined recess shape.

3. A drawer organizer as in claim 2, wherein each of said connector plates has a depth substantially equal to the depth of each of said recesses, such that said connector plates, when received within said recesses, define with said upper surface of said associated panels a substantially continuous surface.

4. A drawer organizer as in claim 2, wherein said recesses each have the form of a right isosceles triangle, and said connector plates each have the form of a square.

5. A drawer organizer, comprising:

multiple components for selective assembly, each of said components including a base panel having at least one opening therein, a portion of said components each having said base panel in the form of a right isosceles triangle, and the remainder of said components each having said base panel in the form of a square, each of said base panels including at least one abutment edge, said abutment edge of each of said components, upon assembly of said components into said drawer organizer, being immediately adjacent said abutment edge of an adjacent one of said components; and a plurality of connector plates for releasably securing said adjacent ones of said components, each of said connector plates having a mounting position in an overlying relationship to said base panels of said adjacent ones of said components, each of said connector plates including a plurality of projections extending therefrom, said projections being located to be received and releasably secured within said openings in said base panels of said adjacent ones of said components when said connector plates are in said mounting position.

6. A drawer organizer as in claim 5, wherein each of said base panels includes an upper surface, and further includes a recess associated with each of said at least one abutment edges, each said recess extending into said upper surface of an associated one of said base panels, and opening on to said associated abutment edge, said recesses being positioned upon said base panels such that, upon assembly of said components into said drawer organizer, said recesses of said adjacent ones of said components are at least partially coextensive to together defme a combined recess shape, and wherein each of said connector plates has a shape corresponding to said combined recess shape.

7. A drawer organizer as in claim 6, wherein each of said connector plates has a depth substantially equal to the depth of each of said recesses, such that said connector plates, when received within said recesses, define with said upper surface of said associated panels a substantially continuous surface.

8. A drawer organizer as in claim 6, wherein said recesses each have the form of a right isosceles triangle, and said connector plates each have the form of a square.

9. A drawer organizer as in claim 5, wherein certain ones, but less than all, of said components furler include a wall extending upward from an edge of said base panel other than said abutment edge, each of said walls having an inner face with a groove defined therein, said components being assemblable with said walls of adjacent ones of said certain ones of said components in parallel adjacent engagement, and further including at least one mounting clip for releasably securing said walls of said adjacent ones of said certain ones of said components, each said at least one mounting clip selectively extending over said walls of said adjacent ones of said certain ones of said components with free ends of said at least one mounting clip received within said grooves.

10. A drawer organizer as in claim 9, wherein each of said base panels includes an upper surface, and further includes a recess associated with each of said at least one abutment edges, each said recess extending into said upper surface of an associated one of said base panels, and opening on to said associated abutment edge, said recesses being positioned upon said base panels such that, upon assembly of said components into said drawer organizer, said recesses of said adjacent ones of said components are at least partially coextensive to together define a combined recess shape, and wherein each of said connector plates has a shape corresponding to said combined recess shape.

11. A drawer organizer as in claim 10, wherein each of said connector plates has a depth substantially equal to the depth of each of said recesses, such that said connector plates, when received within said recesses, define with said upper surface of said associated panels a substantially continuous surface.

12. A drawer organizer as in claim 10, wherein said recesses each have the form of a right isosceles triangle, and said connector plates each have the form of a square.

13. A drawer organizer, comprising:

multiple components for selective assembly, each of said components including a base panel having at least one opening therein and at least one abutment edge, said abutment edge of each of said components, upon assembly of said components into said drawer organizer, being immediately adjacent said abutment edge of an adjacent one of said components; and a plurality of connector plates for releasably securing said adjacent ones of said components, each of said connector plates having a mounting position in an overlying relationship to said base panels of said adjacent ones of said components, each of said connector plates including a plurality of projections extending therefrom, said projections being located to be received and releasably secured within said openings in said base panels of said adjacent ones of said components when said connector plates are in said mounting position, and at least one of said connector plates including an elongate divider projecting vertically therefrom, said divider extending longitudinally across and beyond said at least one of said connector plates.

14. A drawer organizer as in claim 13, wherein certain ones, but less than all, of said components further include a wall extending upward from an edge of said base panel other than said abutnent edge, each of said walls having an inner face with a groove defined therein, said components being assemblable with said walls of adjacent ones of said certain ones of said components in parallel adjacent engagement, and further including at least one mounting clip for releasably securing said walls of said adjacent ones of said certain ones of said components, each said at least one mounting clip selectively extending over said walls of said adjacent ones of said certain ones of said components with free ends of said at least one mounting clip received within said grooves.

15. A drawer organizer as in claim 14, wherein each of said base panels includes an upper surface, and further includes a recess associated with each of said at least one abutment edges, each said recess extending into said upper surface of an associated one of said base panels, and opening on to said associated abutment edge, said recesses being positioned upon said base panels such that, upon assembly of said components into said drawer organizer, said recesses of said adjacent ones of said components are at least partially coextensive to together define a combined recess shape, and wherein each of said connector plates has a shape corresponding to said combined recess shape.

16. A drawer organizer as in claim 15, wherein said recesses each have the form of a right isosceles triangle, and said connector plates each have the form of a square.

17. A drawer organizer as in claim 14, wherein a portion of said components each having said base panel in the form of a right isosceles triangle, and the remainder of said components each having said base panel in the form of a square.

18. A drawer organizer as in claim 13, wherein a portion of said components each having said base panel in the form of a right isosceles triangle, and the remainder of said components each having said base panel in the form of a square.

19. A drawer organizer as in claim 18, wherein each of said base panels includes an upper surface, and further includes a recess associated with each of said at least one abutment edges, each said recess extending into said upper surface of an associated one of said base panels, and opening on to said associated abutment edge, said recesses being positioned upon said base panels such that, upon assembly of said components into said drawer organizer, said recesses of said adjacent ones of said components are at least partially coextensive to together define a combined recess shape, and wherein each of said connector plates has a shape corresponding to said combined recess shape.

20. A drawer organizer as in claim 19, wherein said recesses each have the form of a right isosceles triangle, and said connector plates each have the form of a square.

* * * * *